US011584140B2

(12) United States Patent
Paskalova

(10) Patent No.: US 11,584,140 B2
(45) Date of Patent: Feb. 21, 2023

(54) CONCEALABLE MARKING

(71) Applicant: KYOCERA Document Solutions Inc., Osaka (JP)

(72) Inventor: Svetlana Paskalova, Torrance, CA (US)

(73) Assignee: KYOCERA Document Solutions Inc., Osaka (JP)

( * ) Notice: Subject to any disclaimer, the term of this patent is extended or adjusted under 35 U.S.C. 154(b) by 285 days.

(21) Appl. No.: 16/945,659

(22) Filed: Jul. 31, 2020

(65) Prior Publication Data

US 2022/0032671 A1 Feb. 3, 2022

(51) Int. Cl.

| | |
|---|---|
| ***B41M 5/00*** | (2006.01) |
| ***B41M 5/26*** | (2006.01) |
| ***B41J 3/50*** | (2006.01) |
| ***B41J 3/407*** | (2006.01) |
| ***B41J 11/00*** | (2006.01) |

(52) U.S. Cl.

CPC ..... *B41J 11/0015* (2013.01); *B41J 3/407* (2013.01); *B41J 3/50* (2013.01); *B41M 5/0011* (2013.01); *B41M 5/26* (2013.01)

(58) Field of Classification Search

CPC . B41M 5/0011; B41M 5/26; B41J 3/50; B41J 3/407; B41J 11/0015

See application file for complete search history.

(56) References Cited

U.S. PATENT DOCUMENTS

| | | | | |
|---|---|---|---|---|
| 5,262,208 | A | 11/1993 | Krapivina | |
| 5,328,576 | A | 7/1994 | Paskalov | |
| 5,344,462 | A | 9/1994 | Paskalov | |
| 6,861,012 | B2 | 3/2005 | Gardner et al. | |
| 7,682,523 | B2 | 3/2010 | Weisman | |
| 10,388,494 | B2 | 8/2019 | Paskalova | |
| 10,513,136 | B2 | 12/2019 | Paskalova | |
| 10,682,875 | B2 | 6/2020 | Paskalova | |
| 2010/0147794 | A1 * | 6/2010 | De Vries | H01J 37/3266 156/345.46 |

FOREIGN PATENT DOCUMENTS

| | | | |
|---|---|---|---|
| EP | 1209897 | B1 | 7/2008 |
| JP | 2002370479 | A * | 12/2002 |
| JP | 2008213242 | A * | 9/2008 |

* cited by examiner

*Primary Examiner* — Matthew Luu
*Assistant Examiner* — Kendrick X Liu
(74) *Attorney, Agent, or Firm* — W. Webostad

(57) ABSTRACT

Systems and methods relate generally to a concealable marking. In an example, obtained is a printing device having a printhead, a plasma head, a platform, and a stencil holder. The printhead is configured to print to a surface of a medium. The plasma head is configured to provide a plasma. The platform is configured to support and transport the medium. The stencil holder is configured to hold a stencil between the surface of the medium and the plasma head. A region of the surface of the medium is covered with the stencil. The stencil defines at least one opening for exposure of a portion of the region of the surface. A plasma is generated with the plasma head. The portion of the surface of the medium is exposed to the plasma through the at least one opening to hydrophilize the portion of the surface thereof to provide the concealable marking.

14 Claims, 10 Drawing Sheets

CONCEALABLE MARKING

FIELD

The following description relates to marking a medium. More particularly, the following description relates to marking a medium with a concealable mark.

BACKGROUND

Conventionally, watermarking may be used to form an identifying mark, a security or an anti-counterfeit mark on a medium. Watermarks are generally viewable with reflected lighting, atop a dark background, or backlighting. Watermarks are conventionally formed with a press or mold to impress same.

Generally, watermarks are generally readily viewable, but may be difficult to distinguish one from another. On the other hand, invisible ink, security ink, or sympathetic ink, which is invisible upon application or immediately thereafter, may be used to conceal a message, which message may be revealed such as by heat, chemical reaction, or ultraviolet light, among others depending upon the disappearing ink.

SUMMARY

In accordance with one or more below described examples, a method relating generally to forming a concealable marking on a medium is disclosed. In such a method, obtained is a printing device having a printhead, a plasma head, a platform, and a stencil holder. The printhead is configured to print to a surface of the medium. The plasma head is configured to provide a plasma. The platform is configured to support and transport the medium. The stencil holder is configured to hold a stencil between the surface of the medium and the plasma head. A region of the surface of the medium is covered with the stencil. The stencil defines at least one opening for exposure of a portion of the region of the surface. A plasma is generated with the plasma head. The portion of the surface of the medium is exposed to the plasma through the at least one opening to hydrophilize the portion of the surface thereof to provide the concealable marking.

In accordance with one or more below described examples, another method relating generally to forming a concealable marking on a medium is disclosed. In such a method, obtained is a printing device having a printhead, at least one plasma head, a platform, and a stencil holder. The printhead is configured to print to a surface of the medium. The at least one plasma head is configured to provide at least one plasma. The platform is configured to support and transport the medium. The stencil holder is configured to hold a stencil between the surface of the medium and the plasma head. A first region of the surface of the medium is first covered with a first stencil. The first stencil defines at least one first opening for exposure of a first portion of the region of the surface. The at least one plasma is first generated with the at least one plasma head. The first portion of the surface of the medium is exposed to the at least one plasma to hydrophilize the first portion of the surface thereof. A second portion of the region of the surface of the medium is covered with a second stencil. The second stencil defines at least one second opening for exposure of the second portion of the region of the surface and is different from the at least one first opening. The second covering includes aligning the second stencil to have the at least one second opening at least partially overlap the first portion. The at least one plasma is second generated with the at least one plasma head. The second portion of the surface of the medium is exposed to the at least one plasma from the at least one plasma head to hydrophilize the second portion of the surface thereof including to further hydrophilize an at least partially overlapped portion with the first portion to provide the concealable marking on the medium.

In accordance with one or more below described examples, a system relating generally to forming a concealable marking on a medium is disclosed. In such a system, a printhead is configured to print to a surface of the medium. A plasma head is configured to provide a plasma for an exposed portion of the surface of the medium. A platform is configured to support and transport the medium. A stencil holder is configured to hold a stencil between the surface of the medium and the plasma head. The plasma head is configured to provide the plasma to the exposed portion of the surface of the medium through an opening in the stencil to hydrophilize the exposed portion of the surface thereof.

Other features will be recognized from consideration of the Detailed Description and Claims, which follow.

BRIEF DESCRIPTION OF THE DRAWINGS

Accompanying drawings show exemplary apparatus(es) and/or method(s). However, the accompanying drawings should not be taken to limit the scope of the claims, but are for explanation and understanding only.

FIG. 2-1 is a block diagram top-down view depicting an example of a printed result in a dry state.

FIG. 2-2 is a block diagram top-down view depicting an example of printed result in a wet state.

FIG. 2-3 is a block diagram top-down view depicting another example of a printed result in a dry state.

FIG. 2-4 is a block diagram top-down view depicting another example of a printed result in a wet state.

FIG. 3-1 is a block diagram side view depicting a print medium in a pre-plasma treatment state after wetting.

FIG. 3-2 is a block diagram side view depicting a print medium in a post-plasma treatment state after wetting.

FIG. 3-3 is a block diagram side view depicting an example of a printing system, which may be used for forming a concealable marking on a medium.

FIG. 3-4 is a block diagram break-away side view depicting an example of another printing system, which may be used for forming a concealable marking on a medium.

FIG. 3-5 is a block-flow diagram depicting an example of another concealable marking flow.

FIG. 3-6 is a block-flow diagram depicting an example of yet another concealable marking flow.

FIG. 4 is a pictorial diagram depicting an example of a network.

FIG. 5 is block diagram depicting an example of a portable communication device.

FIG. 6 is a block diagram depicting an example of a multi-function printer (MFP).

DETAILED DESCRIPTION

Figure 1:
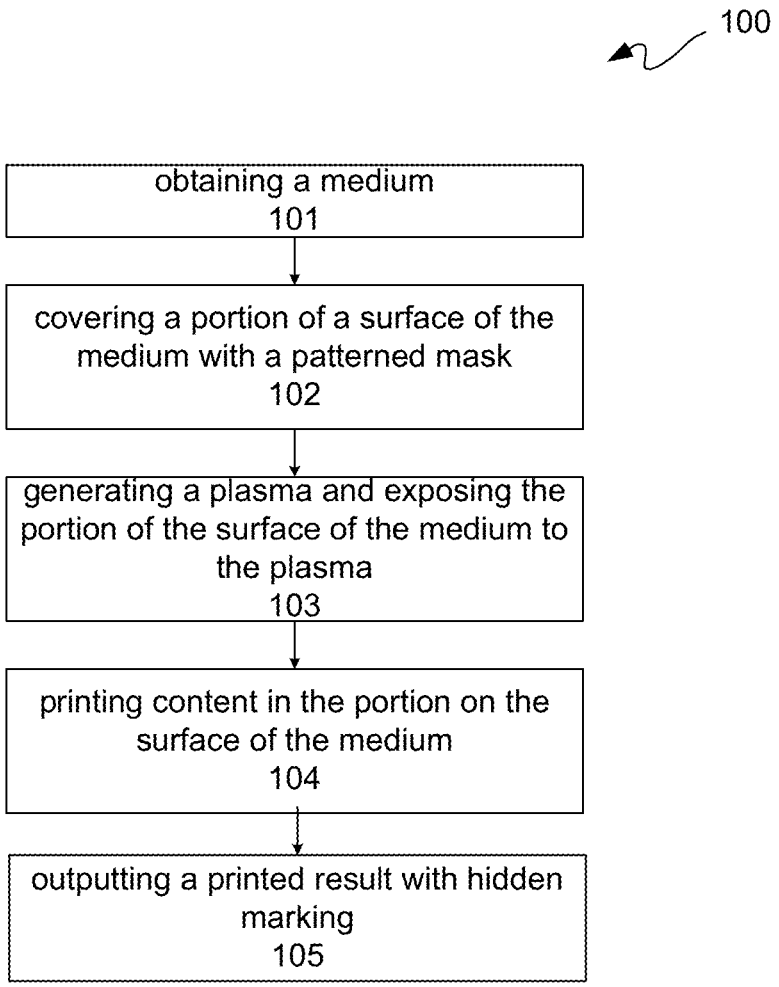
FIG. 1 is a block-flow diagram depicting an example of a concealable marking flow.

In the following description, numerous specific details are set forth to provide a more thorough description of the specific examples described herein. It should be apparent, however, to one skilled in the art, that one or more other examples and/or variations of these examples may be practiced without all the specific details given below. In other instances, well known features have not been described in detail so as not to obscure the description of the examples herein. For ease of illustration, the same number labels are used in different diagrams to refer to the same items; however, in alternative examples the items may be different.

Exemplary apparatus(es) and/or method(s) are described herein. It should be understood that the word "exemplary" is used herein to mean "serving as an example, instance, or illustration." Any example or feature described herein as "exemplary" is not necessarily to be construed as preferred or advantageous over other examples or features.

Before describing the examples illustratively depicted in the several figures, a general introduction is provided to further understanding.

As previously indicated, watermarking and invisible inks have been used. However, as described below in additional detail, a concealable marking is provided using a plasma treatment. More particularly, a plasma head for an atmospheric gas plasma may be used, which may be incorporated into a printing device with a print head. Even though an example of an atmospheric gas plasma is described below, different types of plasma gas, such as oxygen, air, nitrogen, any noble gas(es), or mixture of gases may be used. Also, plasma could be at atmospheric pressure or low pressure.

With the above general understanding borne in mind, various configurations for systems, and methods therefor, with plasma treatment capabilities are generally described below for forming a concealable marking.

Reference will now be made in detail to examples which are illustrated in the accompanying drawings. In the following detailed description, numerous specific details are set forth in order to provide a thorough understanding of the following described implementation examples. It should be apparent, however, to one skilled in the art, that the implementation examples described below may be practiced without all the specific details given below. Moreover, the example implementations are not intended to be exhaustive or to limit scope of this disclosure to the precise forms disclosed, and modifications and variations are possible in light of the following teachings or may be acquired from practicing one or more of the teachings hereof. The implementation examples were chosen and described in order to best explain principles and practical applications of the teachings hereof to enable others skilled in the art to utilize one or more of such teachings in various implementation examples and with various modifications as are suited to the particular use contemplated. In other instances, well-known methods, procedures, components, circuits, and/or networks have not been described in detail so as not to unnecessarily obscure the described implementation examples.

For purposes of explanation, specific nomenclature is set forth to provide a thorough understanding of the various concepts disclosed herein. However, the terminology used herein is for the purpose of describing particular examples only and is not intended to be limiting. As used herein, the singular forms "a", "an" and "the" are intended to include the plural forms as well, unless the context clearly indicates otherwise. As used herein, the term "if" may be construed to mean "when" or "upon" or "in response to determining" or "in response to detecting," depending on the context. Similarly, the phrase "if it is determined" or "if [a stated condition or event] is detected" may be construed to mean "upon determining" or "in response to determining" or "upon detecting [the stated condition or event]" or "in response to detecting [the stated condition or event]," depending on the context. It will also be understood that the term "and/or" as used herein refers to and encompasses any and all possible combinations of one or more of the associated listed items. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof. It will also be understood that, although the terms first, second, etc., may be used herein to describe various elements, these elements should not be limited by these terms, as these terms are only used to distinguish one element from another.

Some portions of the detailed descriptions that follow are presented in terms of algorithms and symbolic representations of operations on data bits, including within a register or a memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those involving physical manipulations of physical quantities. Usually, though not necessarily, these quantities take the form of optical, electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the following discussion, it is appreciated that throughout the description, discussions utilizing terms such as "processing" or "computing" or "calculating" or "determining" or "displaying" or the like, refer to the action and processes of a computer system, or similar electronic computing device, that manipulates and transforms data represented as physical (electronic) quantities within the computer system's registers or memories into other data similarly represented as physical quantities within the computer system memories or registers or other such information storage, transmission or display devices.

Concepts described herein may be embodied as apparatus, method, system, or computer program product. Accordingly, one or more of such implementation examples may take the form of an entirely hardware implementation example, an entirely software implementation example (including firmware, resident software, and micro-code, among others) or an implementation example combining software and hardware, and for clarity any and all of these implementation examples may generally be referred to herein as a "circuit," "module," "system," or other suitable terms. Furthermore, such implementation examples may be of the form of a computer program product on a computer-usable storage medium having computer-usable program code in the medium.

Any suitable computer usable or computer readable medium may be utilized. The computer-usable or computer-readable medium may be, for example but not limited to, an electronic, magnetic, optical, electromagnetic, infrared, or semiconductor system, apparatus, device, or propagation medium. More specific examples (a non-exhaustive list) of the computer-readable medium would include the following: an electrical connection having one or more wires, a portable computer diskette, a hard disk, a random access memory ("RAM"), a read-only memory ("ROM"), an erasable programmable read-only memory ("EPROM" or Flash memory), an optical fiber, a portable compact disc read-only memory ("CD-ROM"), an optical storage device, a transmission media such as those supporting the Internet or an intranet, or a magnetic storage device. The computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory. In the context of this document, a computer-usable or computer-readable medium may be any medium that can contain, store, communicate, propagate, or transport the program for use by or in connection with the instruction execution system, apparatus, or device. The computer-usable medium may include a propagated data signal with the computer-usable program code embodied therewith, either in baseband or as part of a carrier wave. The computer usable program code may be transmitted using any appropriate medium, including but not limited to the Internet, wireline, optical fiber cable, radio frequency ("RF") or other means. For purposes of clarity by way of example and not limitation, the latter types of media are generally referred to as transitory signal bearing media, and the former types of media are generally referred to as non-transitory signal bearing media.

Computer program code for carrying out operations in accordance with concepts described herein may be written in an object-oriented programming language such as Java, Smalltalk, C++ or the like. However, the computer program code for carrying out such operations may be written in conventional procedural programming languages, such as the "C" programming language or similar programming languages. The program code may execute entirely on the user's computer, partly on the user's computer, as a standalone software package, partly on the user's computer and partly on a remote computer or entirely on the remote computer or server. In the latter scenario, the remote computer may be connected to the user's computer through a local area network ("LAN") or a wide area network ("WAN"), or the connection may be made to an external computer (for example, through the Internet using an Internet Service Provider).

Systems and methods described herein may relate to an apparatus for performing the operations associated therewith. This apparatus may be specially constructed for the purposes identified, or it may include a general-purpose computer selectively activated or reconfigured by a computer program stored in the computer.

Notwithstanding, the algorithms and displays presented herein are not inherently related to any particular computer or other apparatus. Various general-purpose systems may be used with programs in accordance with the teachings herein, or it may prove convenient to construct a more specialized apparatus to perform the operations. In addition, even if the following description is with reference to a programming language, it should be appreciated that any of a variety of programming languages may be used to implement the teachings as described herein.

One or more examples are described below with reference to flowchart illustrations and/or block diagrams of methods, apparatus (including systems) and computer program products. It will be understood that each block of the flowchart illustrations and/or block diagrams, and combinations of blocks in the flowchart illustrations and/or block diagrams, may be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer program instructions may also be stored in a computer-readable memory that can direct a computer or other programmable data processing apparatus to function in a particular manner, such that the instructions stored in the computer-readable memory produce an article of manufacture including instruction means which implement the function/act specified in the flowchart and/or block diagram block or blocks. The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide steps for implementing the functions/acts specified in the flowchart and/or block diagram block or blocks.

The flowcharts and block diagrams in the Figures illustrate the architecture, functionality, and operation of possible implementations of apparatuses (including systems), methods and computer program products according to various implementation examples. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems which perform the specified functions or acts, or combinations of special purpose hardware and computer instructions.

It should be understood that although the flow charts provided herein show a specific order of operations, it is understood that the order of these operations may differ from what is depicted. Also, two or more operations may be performed concurrently or with partial concurrence. Such variation will depend on the software and hardware systems chosen and on designer choice. It is understood that all such variations are within the scope of the disclosure. Likewise, software and web implementations may be accomplished with standard programming techniques with rule-based logic and other logic to accomplish the various database searching operations, correlation operations, comparison operations and decision operations. It should also be understood that the word "component" as used herein is intended to encompass implementations using one or more lines of software code, and/or hardware implementations, and/or equipment for receiving manual inputs.

FIG. 1 is a block-flow diagram depicting an example of a concealable marking flow 100. Concealable marking flow 100 may be used for forming a concealable marking on a medium. Even though the following example is described in terms of paper as a print medium, any matter subject to being made hydrophilic or more hydrophilic by exposure to an atmospheric oxygen plasma may be used.

At operation 101, a medium on which to treat an area or region of a surface thereof with a plasma treatment may be obtained. A plasma treatment as described below in additional detail may be used for forming hidden or latent marks for purposes of security, authenticity, and/or anti-counterfeiting. However, such a plasma treatment may in some circumstances may be used to provide an artistic or other aesthetic.

At operation 102, a region or area of a surface of a medium, such as a print medium, may be covered with a stencil. Even though a stencil is described for purposes of clarity, a resist may be deposited and patterned to provide a stencil or patterned mask in another example.

At operation 103, such a portion of such surface of a print medium may be exposed to a plasma generated from a plasma head to hydrophilize such portion of such surface thereof to provide a concealable marking. Such a stencil may define at least one opening for exposure of an underlying portion in such area or region of a surface of a print medium.

A printing operation 104, which may precede or follow a plasma treatment exposing operation 103, may be performed to print to a print medium. Such a printing may be an ink-based or a toner-based printing. At operation 105, a printed result may be output. Such a printed result includes at least one hidden marking responsive to plasma treatment exposing operation 103.

Figures 1, 2:
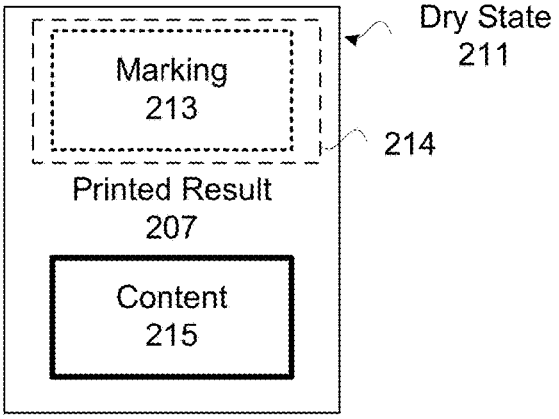
Figure 2:
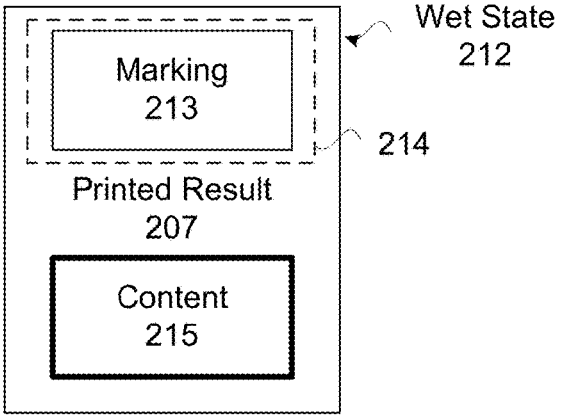

An application of plasma surface treatment as described herein may be used for verifying authenticity, originality, source, or other anti-counterfeiting measure of goods, including goods having a printing. FIG. 2-1 is a block diagram depicting an example of a printed result 207 in a dry state 211. In the dry state 211, printed result 207 may have directly human viewable content 215 and a concealed marking (as generally indicated with dotted lines) 213 in a region 214 of a surface of a medium used to provide printed result 207, where such concealed marking 213 is not directly viewable by a human in a dry state 211.

FIG. 2-2 is a block diagram depicting the example of printed result 207 in a wet state 212. In a wet state 212, printed result 207 still has directly human viewable content 215; however, in a wet state 212, marking (as generally indicated with solid lines) 213 is directly viewable by a human in such a wet state 212. This may be due to a difference in a visually perceptible contrast between an untreated portion of a surface of a print medium and a plasma surface treated portion of such surface.

Figures 2, 3:
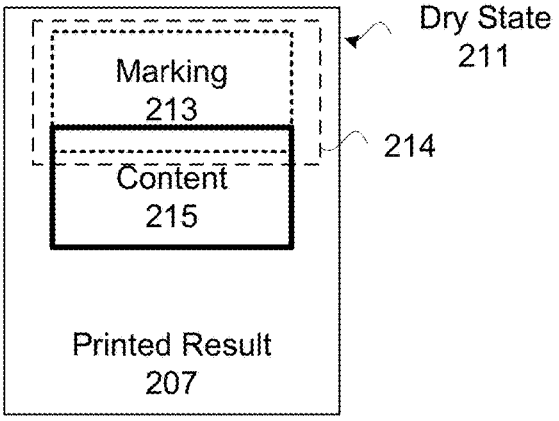

FIG. 2-3 is a block diagram depicting an example of a printed result 207 in a dry state 211. In a dry state, printed result 207 may have directly human viewable content 215 and a concealed marking (as generally indicated with dotted lines) 213, where such concealed marking 213 is not directly viewable by a human in a dry state 211, as previously described. However, in this example, content 215 is printed, either before or after forming marking 213, so as to partially or wholly overlap region 214 including a portion of such concealed marking 213.

Figures 2, 3, 4:
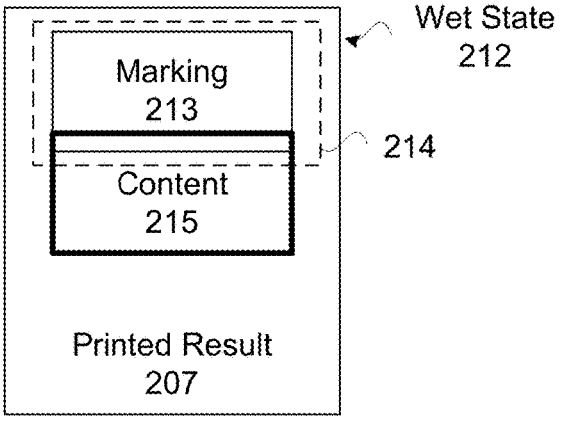

FIG. 2-4 is a block diagram depicting the example of printed result 207 in a wet state 212. In a wet state, printed result 207 still has directly human viewable content 215 though partially or wholly overlapping marking 213. Still in a wet state 212, marking (as generally indicated with solid lines) 213 is directly viewable by a human in such a wet state 212. Contrast between a hydrophilic treated region and an untreated region indicated presence of mark 213 by direct observation, while possibly more difficult to ascertain owing to printed content 215, may still be directly viewed by a human.

A hydrophilic plasma surface treatment as described herein may produce a permanent, high surface energy layer on a print medium material. Such a plasma processed material may attract water, saliva, or other liquids. This attraction may be used in conjunction with wetting of a treated surface or surface portion to make visible a previously concealed, or previously invisible to a human eye, mark or marking.

A wetted surface may have droplets of a wetting liquid. With reference to FIG. 3-1, there is shown a block diagram depicting a print medium 305 in a pre-plasma treatment state 331 after wetting. A droplet or liquid drop 320 may rest on a surface 322 of a print medium 305. Drawing a tangent line 321 to an outer surface of such drop 320 from such surface 322, a wettability or contact angle 323 between such surface 322 and such tangent 321 may have a measurement of less than 90 degrees but generally greater than 45 degrees.

With reference to FIG. 3-2, there is shown a block diagram depicting a print medium 305 in a post-plasma treatment state 332 after wetting. A droplet or liquid drop 320 may rest on a surface 322 of a print medium 305 in a plasma treated region, namely hydrophilic region 310. Furthermore, a small quantity of a liquid may be used for purposes of wetting a print medium 305 to make a concealed mark visible to direct viewing by a human eye.

Drawing a tangent line 321 to an outer surface of such drop 320 from such surface 322, a wettability or contact angle 324 may have a measurement of substantially less than 45 degrees for such drop 320 on a hydrophilic region 310. By having a wettability angle 324 of less than half of wettability angle 323, there is a visible a contrast between plasma treated and untreated portions of surface 322 between boundaries of such areas. This contrast allows a naked human eye to observe a marking, which was previously unobservable without indirect viewing, as described below in additional detail.

Hydrophilic region 310 layer of a plasma treated print medium 305 is invisible to a naked human eye, as it generally has a surface thickness of less than a thousand Angstroms, and typically just hundreds of Angstroms nearing thickness of an atomic layer. Accordingly, hydrophilic region 310 may not be directly viewed by a human eye aided by a microscope, but rather may be viewed indirectly by a human through an image produced by a microscope.

Along those lines, to view hydrophilic region 310 as a layer, not as a wetted marking, can involve special techniques and equipment, such as for example a scanning electron microscope ("SEM"). Therefore, in order to determine an item has been plasma treated, a liquid, such as water, saliva, or other non-print medium destructive liquid, may be applied to a processed part of print media material. Such a treated part immediately absorbs such liquid becoming visible to a naked human eye. Of course, a marking may be made substantially small to prevent or substantially hinder direct viewing with a naked human eye in other examples; however, for purposes of clarity and not limitation, it is assumed that area of a marking is sufficiently large as to be observable by a person having 20-20 vision without aid of any imaging enhancement device, such as a magnifying glass or optical microscope for example.

As hydrophilic region 310 dries, or once hydrophilic region 310 has dried up, a plasma treatment-stenciled mark may once again become invisible to direct human viewing. Such a concealed image, which may be of any shape, text, and/or figure, made by plasma modification of a surface to hydrophilize same. Furthermore, such a treatment may be made on a corner or any place on a print medium. Again, a print medium is not limited to cellulose-containing sheet goods, but may be leather, fabric, polymer, or other material.

Plasma treatment as described herein need not involve any added chemical and/or any ink. In an example, a plasma treatment as described herein may use only air and a low energy source for plasma gas generation. However, in another example, a plasma gas for hydrophilic treatment as described herein may be air, oxygen, or a mixture of air and oxygen, or other type of plasma gas as previously described.

Accordingly, a plasma treatment marking may be an inkless marking. Furthermore, a plasma treatment marking may be formed without any impressing, namely without a press or mold impression.

A plasma treatment as described herein may provide a high efficiency of surface activation for various materials. Such activation may be by dual actions of radicals and charged particles (e.g., electrons and ions). In addition, a plasma treatment as described herein does not alter mechanical properties of print medium 305.

In an example, an atmospheric RF plasma generator, based on 13.56 MHz RF power supply with an L-C matching network and power level of 100 to 300 Watts (W), may be used. However, other plasma generators or settings thereof may be used, as may vary with application including without limitation print medium 305 used. Along those lines, a plasma head may be operated in a range of frequencies, such as from 0.1 MHz to 150 MHz, and in a range of power levels, such as from 50 W to 1 kW. Print medium may pass a single time across a glow-discharge plasma region from a plasma head at a speed of 5 to 20 mm/sec. However, more than one pass may be used in other examples. However, for a paper print medium 305, a surface thereof may be made hydrophilic with a single pass using an atmospheric oxygen plasma at an exposure or linear travel speed and power level as described herein.

Returning to FIG. 1 with additional simultaneous reference to FIGS. 2-1 through 2-4, 3-1 and 3-2, after exposing a portion of a surface 322 of a print medium 305 to an atmospheric oxygen plasma, at operation 103 content 215 may be printed on surface 322, including within such plasma treated portion or hydrophilic region 310 on such surface 322. In this or another example, printing operation 104 may precede plasma treatment exposing operation 103, as printed content 215 on a print medium 305 may be exposed to plasma treatment as described herein. A printed result with a concealed or hidden marking 213, such as printed result 207 for example, may be output at operation 105.

FIG. 3-3 is a block diagram depicting an example of a printing system 300, which may be used for forming a concealable marking on a medium. Printing system 300 is further described with simultaneous reference to FIGS. 1 through 3-3.

Printing system 300 may include a controller 319 for controlling operation of one or more printheads, one or more plasma heads, and movement of a conveyor. However, for purposes of clarity and not limitation, coupling of a controller 319 to such components is not illustratively depicted, though such coupling may use wired and/or wireless communication.

Printing system 300 may include a printhead 301 configured to print to a surface 322 of a print medium 305. Printhead 301 may be an ink-based, toner-based, or other type of printhead configured to apply a colorant 303 to surface 322 to print printed content 215 to such surface.

Printing system 300 may include a plasma head 302 configured to provide a plasma to an exposed portion of a surface 322 of print medium 305. Plasma head 302 may be spaced apart from printhead 301. In this example, printing system 300 includes a platform, namely conveyor-platform 306, configured to support and transport print medium 305. In another example, print medium 305 may be moved with a sheet feeder mechanism onto a platform.

Conveyor-platform 306 may be moved bidirectionally in a linear direction for positioning print medium 305 for printing onto surface 322 by printhead 302 and for applying a plasma treatment to surface 322 by plasma head 302. In another example, conveyor-platform 306 may be moved unidirectionally in a linear direction for positioning print medium 305 for printing onto surface 322 by printhead 302 and then for applying a plasma treatment to surface 322 by plasma head 302. In this example, printhead 301 is positioned to print to surface 322 of print medium 305 prior to exposure to plasma 304.

In yet another example, conveyor-platform 306 may be moved unidirectionally in a linear direction for positioning print medium 305 for applying a plasma treatment to surface 322 by plasma head 302 and then for printing onto surface 322 by printhead 302. In this example, printhead 301 is positioned to print to surface 322 of print medium 305 after exposure to plasma 304.

Printing system 300 may optionally include a stencil holder 309 configured to hold a stencil 306 between surface 322 of print medium 305 and plasma head 302. In another example, a stencil 306 may be laid on surface 322 under plasma head 302. For example, stencil 306 may be a patterned ceramic or metal mask having a thickness of less than 10 millimeters. At least one of stencil 306 or conveyor-platform 306 may be electrically conductive for purposes of further directing application of plasma gas or plasma 304 onto surface 322.

Plasma head 302 may be configured to provide plasma 304 to a portion of surface 322 of print medium 305 through at least one opening 307 in stencil 306 to hydrophilize a corresponding portion of surface 322 with respect to such at least one opening 307, namely hydrophilic region 310 after such plasma treatment. Plasma 304 may be an atmospheric oxygen plasma or other type of plasma gas, as previously described, to provide a concealable marking 213 without having to use any colorant to provide such marking.

FIG. 3-4 is a block diagram depicting an example of another printing system 300, which may be used for forming a concealable marking 213 on a medium 305. Printing system 300 is further described with simultaneous reference to FIGS. 1 through 3-4. FIG. 3-4 is a breakaway view, and so printhead 301 is not shown; however, print system 300 of FIG. 3-4 is the same as that of FIG. 3-3, except another plasma head 312 and another optional stencil holder 319 is added along with a corresponding extension of conveyor-platform 306. Furthermore, another stencil 316 is depicted. Accordingly, many of the details of print system 300 of FIG. 3-4 are the same as previously described, and thus not repeated for purposes of clarity and not limitation.

Printing system 300 may include a plasma head 312 configured to provide a plasma 314 for an exposed portion of a surface 322 of print medium 305. Plasma head 312 may be spaced apart from plasma head 302.

Printing system 300 may optionally include a stencil holder 319 configured to hold a stencil 316 between surface 322 of print medium 305 and plasma head 312. In another example, a stencil 316 may be laid on surface 322 under plasma head 312. For example, stencil 316 may be a patterned ceramic or metal mask having a thickness of less than 10 millimeters. At least one of stencil 316 or conveyor-platform 306 may be electrically conductive for purposes of further directing application of plasma gas or plasma 314 onto surface 322.

Plasma head 312 may be configured to provide plasma 314 to a portion of surface 322 of print medium 305 through at least one opening 317 in stencil 316 to hydrophilize a corresponding portion of surface 322 with respect to such at least one opening 317, namely hydrophilic region 320 after such plasma treatment. Plasma 314 may be an atmospheric oxygen plasma to provide a concealable marking 213 without having to use any colorant to provide such marking.

Along those lines, stencil 306 may be a first stencil defining at least one first opening 307 for exposure of a first hydrophilic region or portion 310 of surface 322, and stencil 316 may be a second stencil defining at least one second opening 317 for exposure of a second hydrophilic region or portion 320 of surface 322. Such first portion 310 and such second portion 320 may be different from one another for reasons as described below in additional detail.

Using two or more stencils to form a concealable marking 213, where application of plasmas used for each of such stencils may be different from one another in power, applied duration, or otherwise, may make replicating or otherwise counterfeiting a concealable marking 213 significantly less possible.

Figures 1, 3:
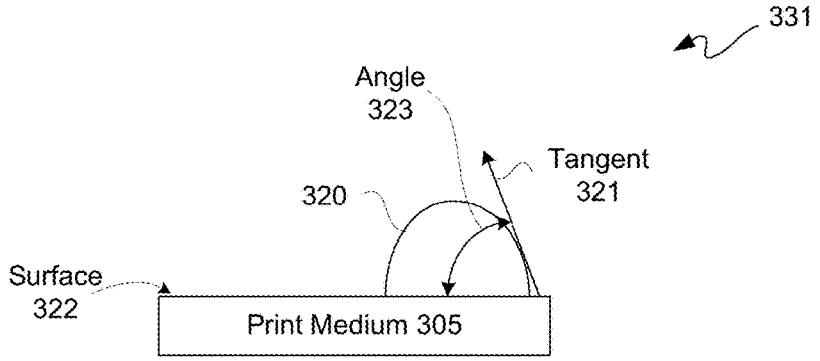
Figures 2, 3:
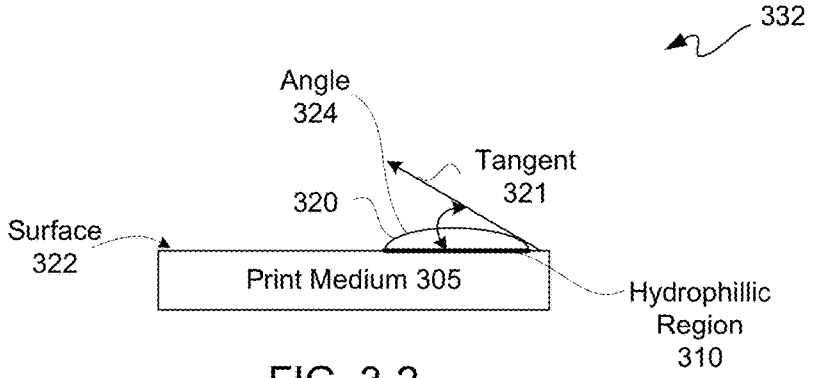
Figure 3:
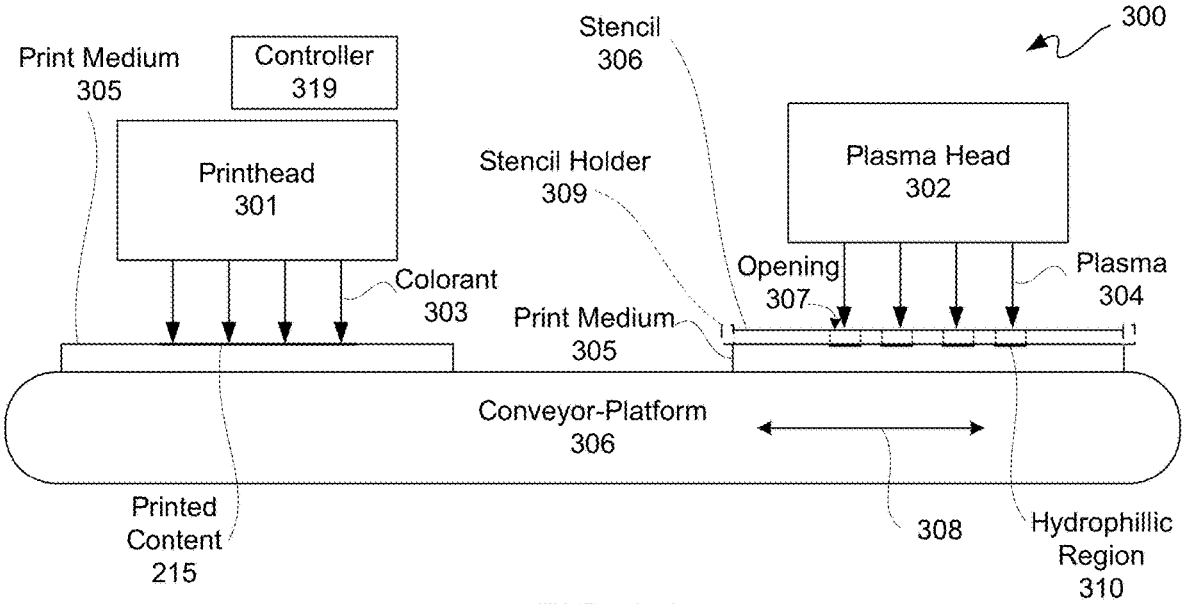
Figures 3, 4:
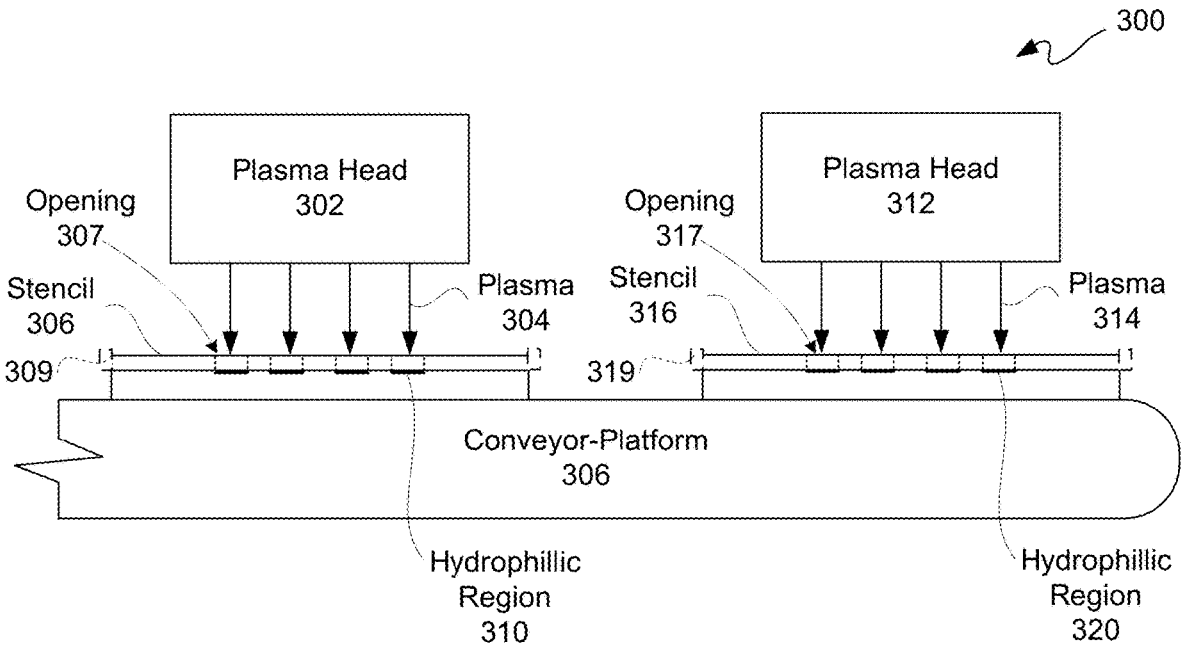
Figures 3, 4, 5:
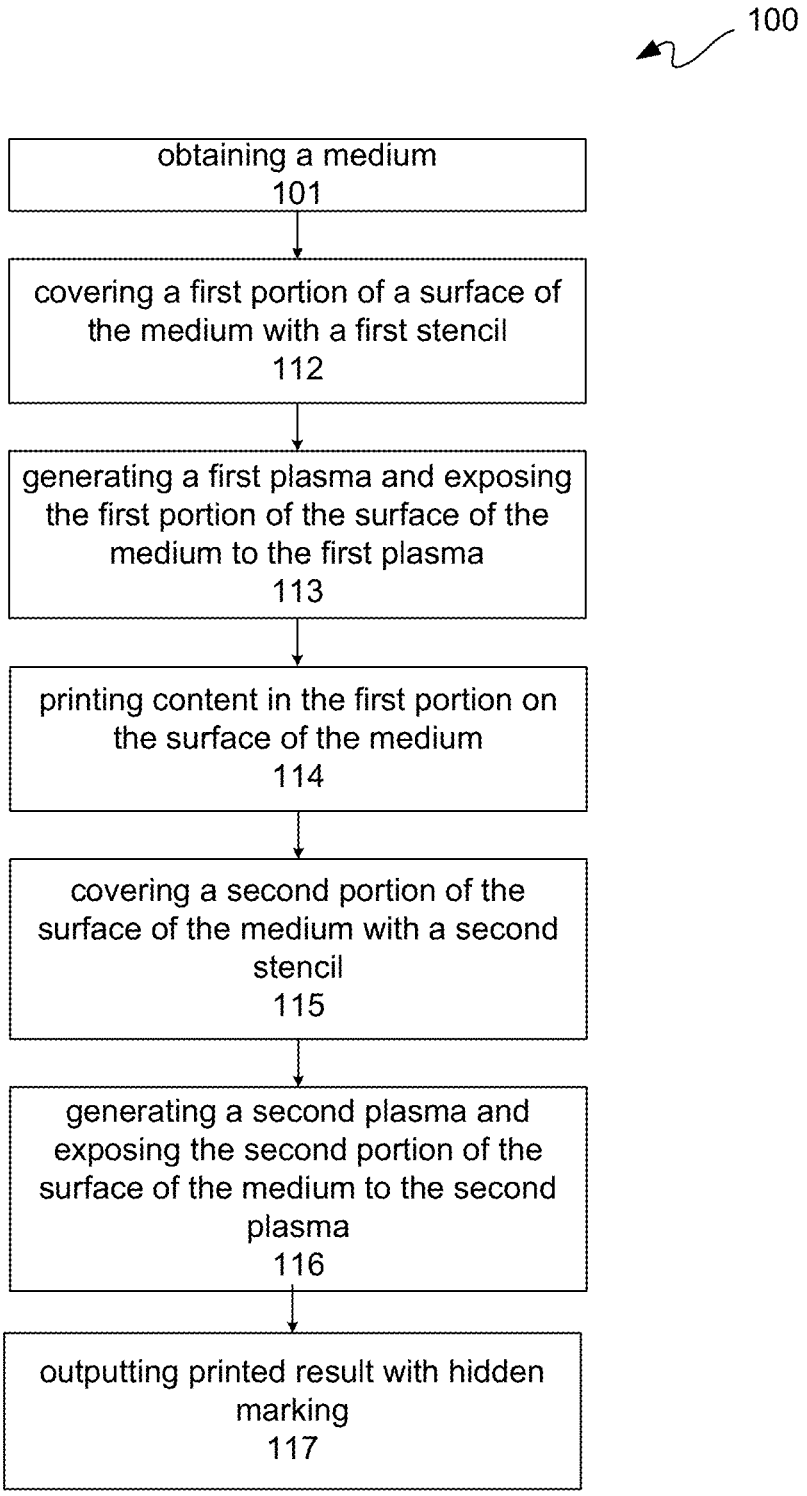

FIG. 3-5 is a block-flow diagram depicting an example of another concealable marking flow 100. Concealable marking flow 100 of FIG. 3-5 is further described with simultaneous reference to FIGS. 1 through 3-5.

Concealable marking flow 100 may be used for forming a concealable marking on a medium. Even though the following example is described in terms of paper as a print medium, any matter subject to being made hydrophilic or more hydrophilic by exposure to an atmospheric oxygen plasma may be used.

At operation 101, a medium on which to treat a portion of a surface thereof with a plasma treatment may be obtained. A plasma treatment as described above in additional detail may be used for forming hidden or latent marks for purposes of security, authenticity, and/or anti-counterfeiting. However, such a plasma treatment may in some circumstances may be used to provide an artistic or other aesthetic.

At operation 112, a first region 214 of a surface 322 of a medium, such as a print medium 305, may be covered with a first stencil 306. Even though a stencil is described for purposes of clarity, a resist may be deposited and patterned to provide a stencil or patterned mask in another example.

Such a first stencil 306 may define at least one opening 307 for exposure of an underlying portion of such region of a surface 322 of a print medium 305. At operation 113, such a portion of such surface of a print medium may be exposed to a plasma 304 generated from a plasma head 302 to hydrophilize such portion of such surface thereof to provide a first portion of a concealable marking 213.

Before or after exposing a portion of a surface 322 of a print medium 305 to an atmospheric oxygen plasma at operation 113, at operation 114 content 215 may be printed on surface 322, including within such plasma treated portion or hydrophilic region 310 on such surface 322. In this example, printing operation 114 may precede a first plasma treatment operation and follow a second plasma treatment operation, as printed content 215 on a print medium 305 may be exposed to plasma treatment as described herein. However, in another example, printing operation 114 may follow all plasma treatment operations.

Along those lines, location of a printhead 301 may preceded or be upstream of all plasma heads, such as plasma heads 302 and 312. In another example, printhead 301 may be located between plasma heads, such as between plasma heads 302 and 312. In yet another example, printhead 301 may follow or be downstream of all plasma heads, such as plasma heads 302 and 312.

At operation 115, a second region 214 of a surface 322 of a print medium 305 may be covered with a second stencil 316. Such first and second regions 214 in this example are the same; however, in another example, different regions may be used. Even though a stencil is described for purposes of clarity, a resist may be deposited and patterned to provide a stencil or patterned mask in another example.

Such a second stencil 316 may define at least one opening 317 for exposure of an underlying portion of a region 214 of a surface 322 of a print medium 305. At operation 116, such a second portion of such surface of a print medium may be exposed to a plasma 314 generated from a plasma head 312 to hydrophilize such portion of such surface thereof to provide a second portion of a concealable marking 213.

Generally, areas or regions of such first and second portions respectively exposed using stencils 306 and 316 may be different from one another for forming a concealable marking 213. While some sections of such areas or regions of such first and second portions may overlap, such as to provide additional or darker contrast, other portions may not overlap, such as to provide a lighter level of contrast. By having different amounts of exposure to plasma, different contrasts may be obtained within a concealable marking 213.

Furthermore, exposure time to plasma 304 from plasma head 302 may be different than exposure time to plasma 312 from second plasma head 312 to respectively provide a first hydrophilic state and a second hydrophilic state on surface 322 observably different from one another in a wet state of such surface. Separately or additionally, first plasma head 302 and second plasma head 312 may be set for different intensities or powers to respectively provide a first hydrophilic state and a second hydrophilic state on surface 322 observably different from one another in a wet state of such surface.

For stencils 306 and 316 different from one another, though in other examples they may be one in the same, at least one opening 307 of stencil 306 may be different from at least one opening 317 of stencil 316 for such openings generally within a same regional section of a marking 213 area. Accordingly, covering operation 116 may include aligning a second stencil 316 to have at least one opening 317 at least partially overlap an exposed portion of surface 322 with respect to stencil 306, such as for example exposed by at least one opening 307. However, in each instance, plasma 304 from plasma head 302 and plasma 314 from plasma head 312 may each be an atmospheric oxygen plasma to provide a concealable marking 213, which may be without use of any colorant.

A printed result with a concealed or hidden marking 213, such as printed result 207 for example, may be output at operation 117. In this example, such a printed result may be from at least one printing with a printhead 301 and at least two plasma treatments from separate plasma heads, such as plasma heads 302 and 312.

FIG. 3-6 is a block-flow diagram depicting an example of yet another concealable marking flow 100. Concealable marking flow 100 of FIG. 3-6 is further described with simultaneous reference to FIGS. 1 through 3-6.

Concealable marking flow 100 may be used for forming a concealable marking on a medium. Even though the following example is described in terms of paper as a print medium, any matter subject to being made hydrophilic or more hydrophilic by exposure to an atmospheric oxygen plasma may be used.

At operation 101, a medium on which to treat a portion of a surface thereof with a plasma treatment may be obtained. A plasma treatment as described above in additional detail may be used for forming hidden or latent marks for purposes of security, authenticity, and/or anti-counterfeiting. However, such a plasma treatment may in some circumstances may be used to provide an artistic or other aesthetic.

At operation 122, a first region of a surface 322 of a medium, such as a print medium 305, may be covered with a first stencil 306. Even though a stencil is described for purposes of clarity, a resist may be deposited and patterned to provide a stencil or patterned mask in another example.

Such a first stencil 306 may define at least one opening 307 for exposure of an underlying portion of such a region 214 of a surface 322 of a print medium 305. At operation 123, such a portion of such surface of a print medium may be exposed to a plasma 304 generated from a plasma head 302 to hydrophilize such portion of such surface thereof to provide a first portion of a concealable marking 213.

At operation 124, a second region of a surface 322 of a medium, such as a print medium 305, may be covered with a second stencil 316. Even though a stencil is described for purposes of clarity, a resist may be deposited and patterned to provide a stencil or patterned mask in another example.

Such a second stencil 316 may define at least one opening 317 for exposure of an underlying portion of a region 214 of a surface 322 of a print medium 305. At operation 125, such a portion of such surface of a print medium may be exposed to a plasma 304 generated from a plasma head 302 to hydrophilize such portion of such surface thereof to provide a second portion of a concealable marking 213.

Second stencil 316 may define at least one second opening 317 for exposure of a second portion of surface 322 different from a at least one first opening 307. In an example, covering operation 124 may include an aligning operation 128 for aligning second stencil 316 to have at least one second opening 317 at least partially overlap a first portion of a marking 213 region, which may or may not at least partially overlap an opening 307 of stencil 306.

Along those lines, a second exposing operation 125 of second portion of surface 322 of print medium 305 to another instance of plasma 304 from plasma head 302 to hydrophilize such second portion of such surface thereof may further hydrophilize such an at least partially overlapped portion with respect to such first portion to provide a concealable marking 213 on such medium. Each such instance of exposure to a plasma 304 may be an atmospheric oxygen plasma to provide a concealable marking 213 without having to include any colorant.

Each of a first stencil 306 and a second stencil 316 may have a thickness of less than 10 millimeters. However, in this example, rather than having multiple plasma heads, a single plasma head 302 may be used where stencils are swapped out one for another. While stencils 306 and 316 may have different thickness, it may be useful to have stencils with a same thickness for purposes of tooling an optional stencil holder 309. Along those lines, while an optional stencil holder 309 may be used for purposes of indexing for alignment, and such an optional stencil holder 309 may be adjustable for such indexing, it may be useful to have stencils 306 and 316 with same lengths and widths.

By having a partially overlapped portion, different shades or contrasts may be provided with marking 213. For example, a first portion having a partial overlap with a second portion respectively associated with openings 307 and 317 may have a darker contrast when wet than a non-overlapped remainder of such first portion. Content 215, such as may include an image, may be printed on any at least partially overlapped portion on such surface 322 of print medium 305 at operation 126.

Even though a plasma 304 is used in each of exposure operations 123 and 125, exposure time to plasma 304 from a first exposing may be the same or different than exposure time to plasma 304 from a second exposing to respectively provide a first hydrophilic state and a second hydrophilic state on surface 322. These different exposure times may be observably different from one another by providing different levels of contrast in a wet state of surface 322.

Furthermore, even though plasma 304 may be a same plasma, power level or intensity of such plasma in exposure operations 123 and 125 may be the same or different. For example, a first intensity of plasma 304 from a first exposing may be different than a second intensity of plasma 304 from the second exposing by adjusting power level up or down. Such a first intensity and a second intensity may be used respectively provide a first hydrophilic state and a second hydrophilic state on surface 322 observably different from one another in a wet state of surface 322 with different contrasts.

Before or after exposing a portion of a surface 322 of a print medium 305 to an atmospheric oxygen plasma at operation 123 and/or 125, at operation 126 content 215 may be printed on surface 322, including within such plasma treated portion or hydrophilic region 310 on such surface 322. In another example, printing operation 126 may precede each plasma treatment operation, even though printed content 215 on a print medium 305 may be exposed to plasma treatment as described herein. However, in this example, printing operation 126 may follow all plasma treatment operations. Such printed matter may be output at operation 127 with a concealed or hidden marking 213.

Because one or more of the examples described herein may be implemented using an information processing system, a detailed description of examples of each of a network (such as for a Cloud-based SaaS implementation), a computing system, a mobile device, and an MFP is provided. However, it should be understood that other configurations of one or more of these examples may benefit from the technology described herein.

FIG. 4 is a pictorial diagram depicting an example of a network 400, which may be used to provide a SaaS platform for hosting a service or micro service for use by a user device, as described herein. Along those lines, network 400 may include one or more mobile phones, pads/tablets, notebooks, and/or other web-usable devices 401 in wired and/or wireless communication with a wired and/or wireless access point ("AP") 403 connected to or of a wireless router. Furthermore, one or more of such web-usable wireless devices 401 may be in wireless communication with a base station 413.

Additionally, a desktop computer and/or a printing device, such as for example one or more multi-function printer ("MFPs") 402, each of which may be web-usable devices, may be in wireless and/or wired communication to and from router 404. An MFP 402 may include at least one plasma head as previously described herein.

Wireless AP 403 may be connected for communication with a router 404, which in turn may be connected to a modem 405. Modem 405 and base station 413 may be in communication with an Internet-Cloud infrastructure 407, which may include public and/or private networks.

A firewall 406 may be in communication with such an Internet-Cloud infrastructure 407. Firewall 406 may be in communication with a universal device service server 408. Universal device service server 408 may be in communication with a content server 409, a web server 414, and/or an app server 412. App server 412, as well as a network 400, may be used for downloading an app or one or more components thereof for accessing and using a service or a micro service as described herein.

FIG. 5 is block diagram depicting an example of a portable communication device ("mobile device") 520. Mobile device 520 may be an example of a mobile device used to instruct a printing device with at least one plasma head to print at least one concealable marking.

Mobile device 520 may include a wireless interface 510, an antenna 511, an antenna 512, an audio processor 513, a speaker 514, and a microphone ("mic") 519, a display 521, a display controller 522, a touch-sensitive input device 523, a touch-sensitive input device controller 524, a microprocessor or microcontroller 525, a position receiver 526, a media recorder 527, a cell transceiver 528, and a memory or memories ("memory") 530.

Microprocessor or microcontroller 525 may be programmed to control overall operation of mobile device 520. Microprocessor or microcontroller 525 may include a commercially available or custom microprocessor or microcontroller.

Memory 530 may be interconnected for communication with microprocessor or microcontroller 525 for storing programs and data used by mobile device 520. Memory 530 generally represents an overall hierarchy of memory devices containing software and data used to implement functions of mobile device 520. Data and programs or apps as described hereinabove may be stored in memory 530.

Memory 530 may include, for example, RAM or other volatile solid-state memory, flash or other non-volatile solid-state memory, a magnetic storage medium such as a hard disk drive, a removable storage media, or other suitable storage means. In addition to handling voice communications, mobile device 520 may be configured to transmit, receive and process data, such as Web data communicated to and from a Web server, text messages (also known as short message service or SMS), electronic mail messages, multimedia messages (also known as MMS), image files, video files, audio files, ring tones, streaming audio, streaming video, data feeds (e.g., podcasts), and so forth.

In this example, memory 530 stores drivers, such as I/O device drivers, and operating system programs ("OS") 537. Memory 530 stores application programs ("apps") 535 and data 536. Data may include application program data.

I/O device drivers may include software routines accessed through microprocessor or microcontroller 525 or by an OS stored in memory 530. Apps, to communicate with devices such as the touch-sensitive input device 523 and keys and other user interface objects adaptively displayed on a display 521, may use one or more of such drivers.

Mobile device 520, such as a mobile or cell phone, includes a display 521. Display 521 may be operatively coupled to and controlled by a display controller 522, which may be a suitable microcontroller or microprocessor programmed with a driver for operating display 521.

Touch-sensitive input device 523 may be operatively coupled to and controlled by a touch-sensitive input device controller 524, which may be a suitable microcontroller or microprocessor. Along those lines, touching activity input via touch-sensitive input device 523 may be communicated to touch-sensitive input device controller 524. Touch-sensitive input device controller 524 may optionally include local storage 529.

Touch-sensitive input device controller 524 may be programmed with a driver or application program interface ("API") for apps 535. An app may be associated with a service, as previously described herein, for use of a SaaS. One or more aspects of above-described apps may operate in a foreground or background mode.

Microprocessor or microcontroller 525 may be programmed to interface directly touch-sensitive input device 523 or through touch-sensitive input device controller 524. Microprocessor or microcontroller 525 may be programmed or otherwise configured to interface with one or more other interface device(s) of mobile device 520. Microprocessor or microcontroller 525 may be interconnected for interfacing with a transmitter/receiver ("transceiver") 528, audio processing circuitry, such as an audio processor 513, and a position receiver 526, such as a global positioning system ("GPS") receiver. An antenna 511 may be coupled to transceiver 528 for bi-directional communication, such as cellular and/or satellite communication.

Mobile device 520 may include a media recorder and processor 527, such as a still camera, a video camera, an audio recorder, or the like, to capture digital pictures, audio and/or video. Microprocessor or microcontroller 525 may be interconnected for interfacing with media recorder and processor 527. Image, audio and/or video files corresponding to the pictures, songs and/or video may be stored in memory 530 as data 536.

Mobile device 520 may include an audio processor 513 for processing audio signals, such as for example audio information transmitted by and received from transceiver 528. Microprocessor or microcontroller 525 may be interconnected for interfacing with audio processor 513. Coupled to audio processor 513 may be one or more speakers 514 and one or more microphones 519, for projecting and receiving sound, including without limitation recording sound, via mobile device 520. Audio data may be passed to audio processor 513 for playback. Audio data may include, for example, audio data from an audio file stored in memory 530 as data 536 and retrieved by microprocessor or microcontroller 525. Audio processor 513 may include buffers, decoders, amplifiers and the like.

Mobile device 520 may include one or more local wireless interfaces 510, such as a WIFI interface, an infrared transceiver, and/or an RF adapter. Wireless interface 510 may provide a Bluetooth adapter, a WLAN adapter, an Ultra-Wideband ("UWB") adapter, and/or the like. Wireless interface 510 may be interconnected to an antenna 512 for communication. As is known, a wireless interface 510 may be used with an accessory, such as for example a hands-free adapter and/or a headset. For example, audible output sound corresponding to audio data may be transferred from mobile device 520 to an adapter, another mobile radio terminal, a computer, or another electronic device. In another example, wireless interface 510 may be for communication within a cellular network or another Wireless Wide-Area Network (WWAN).

Figures 3, 4, 5, 6:
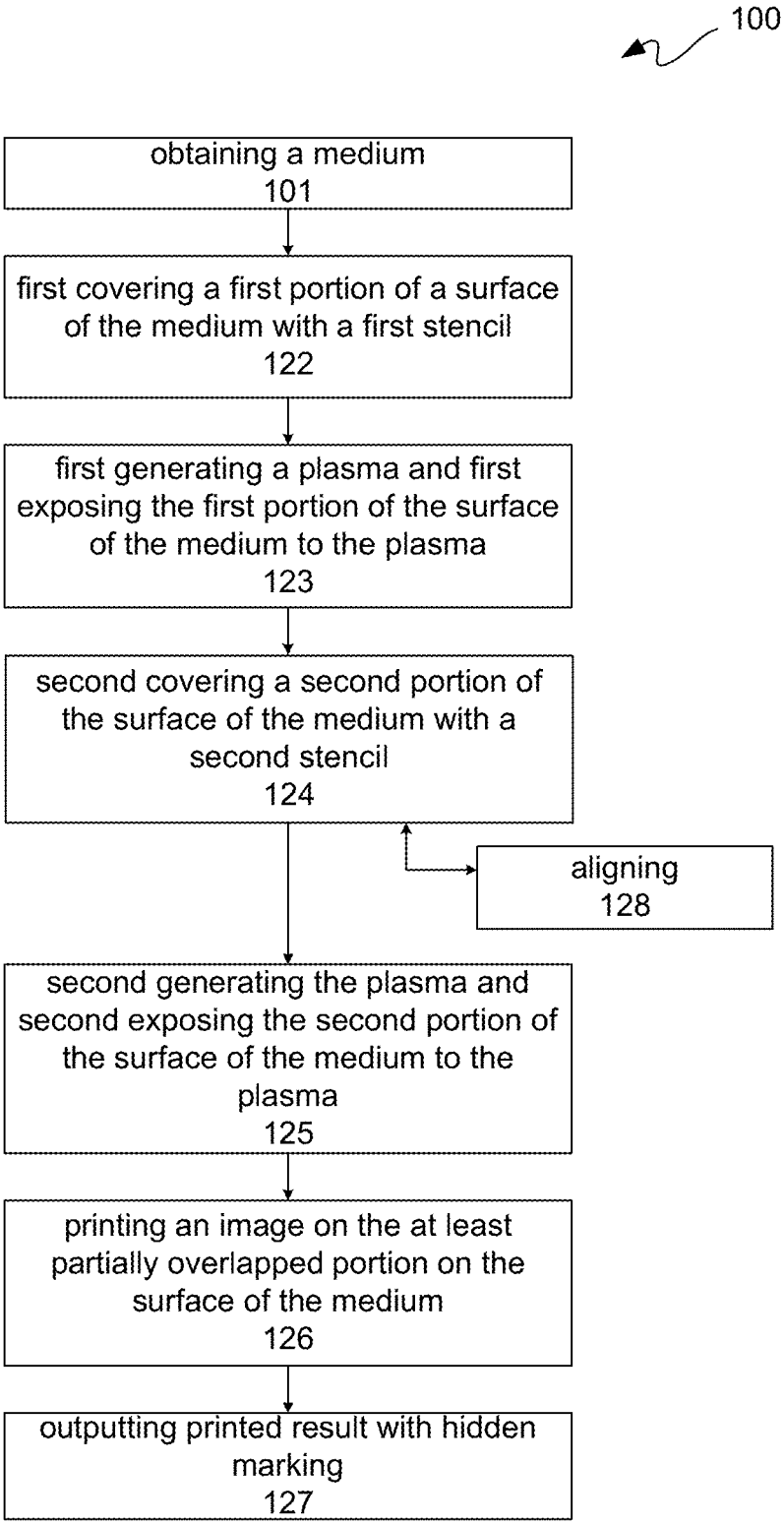
Figure 4:
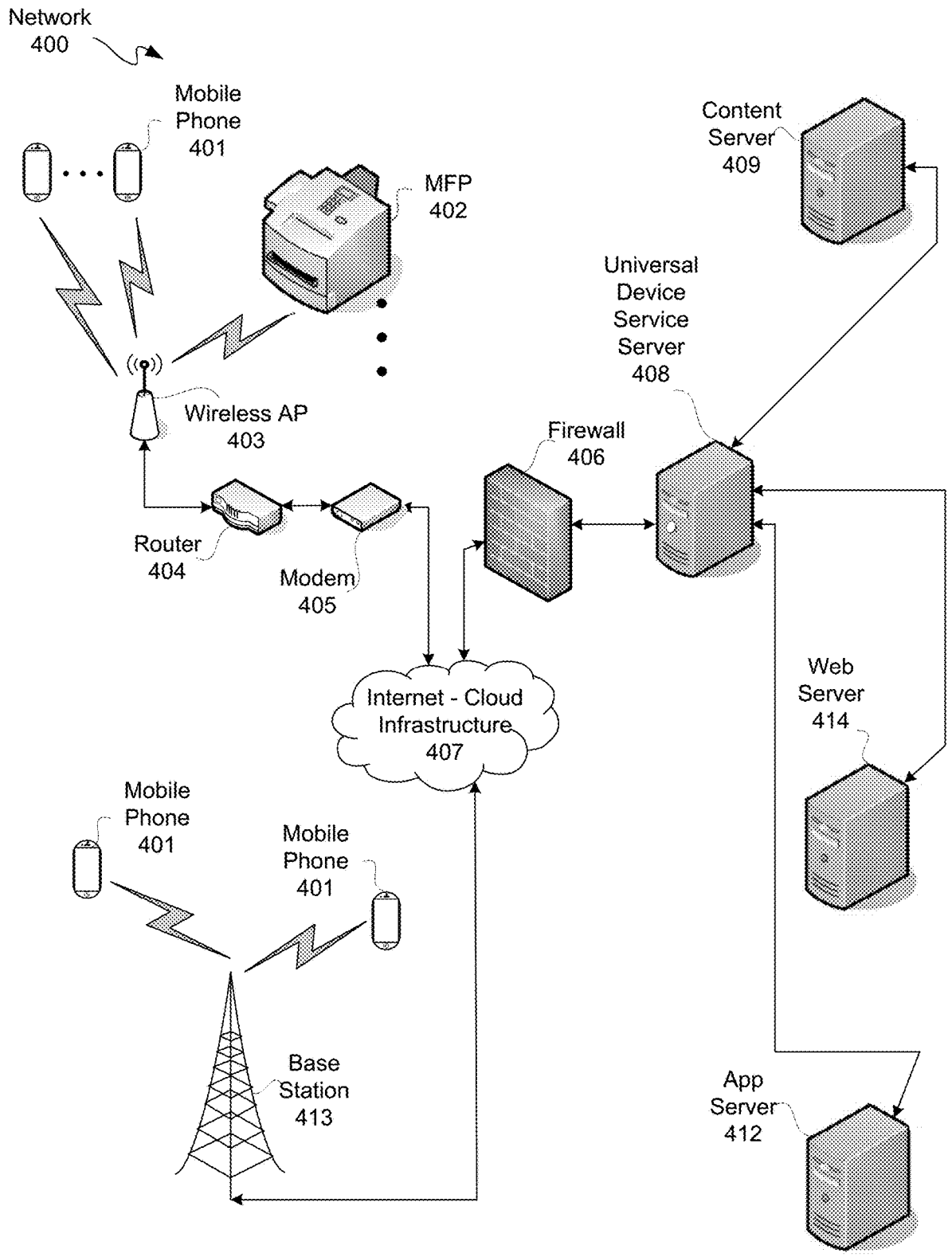
Figure 5:
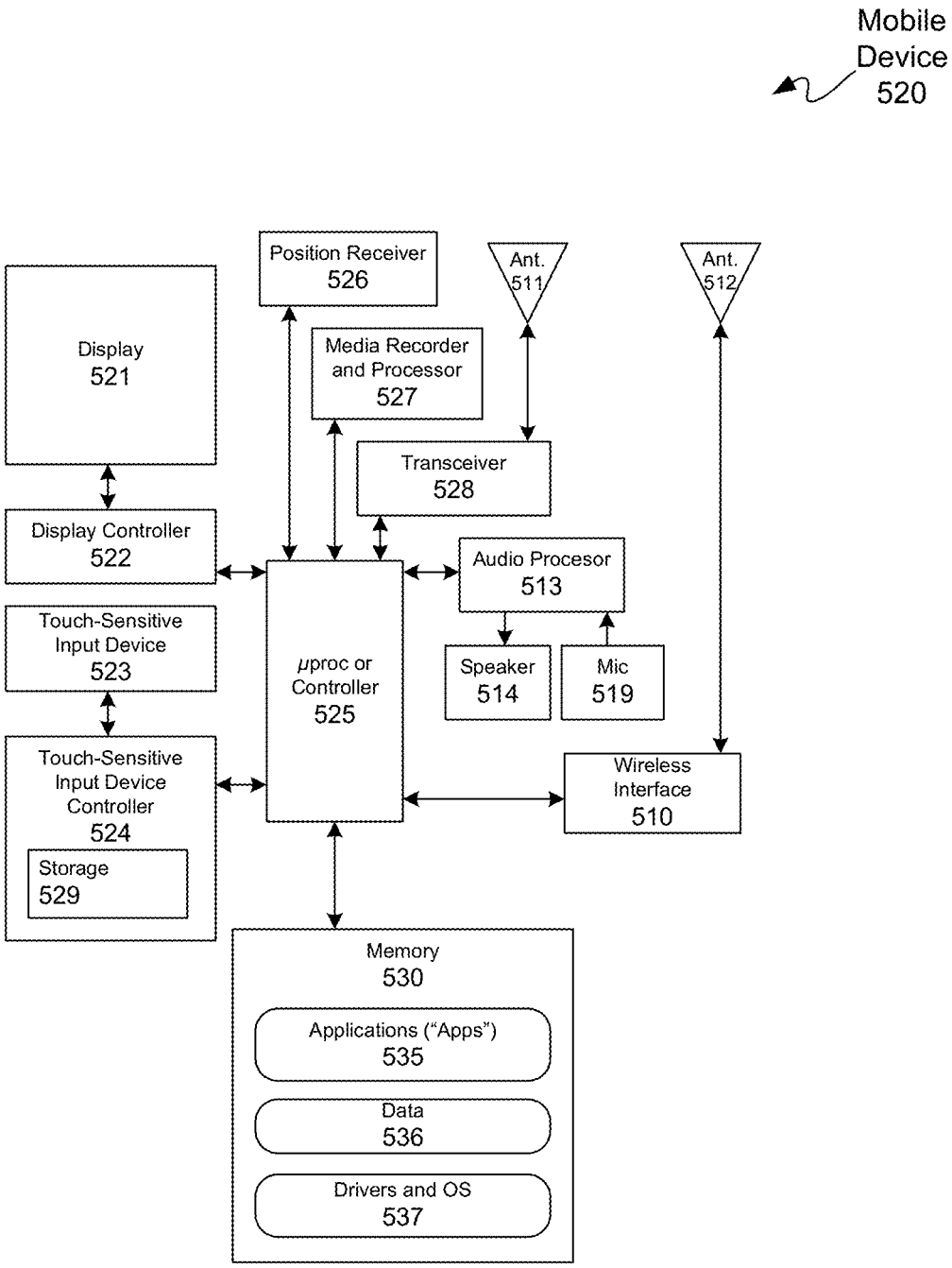
Figure 6:
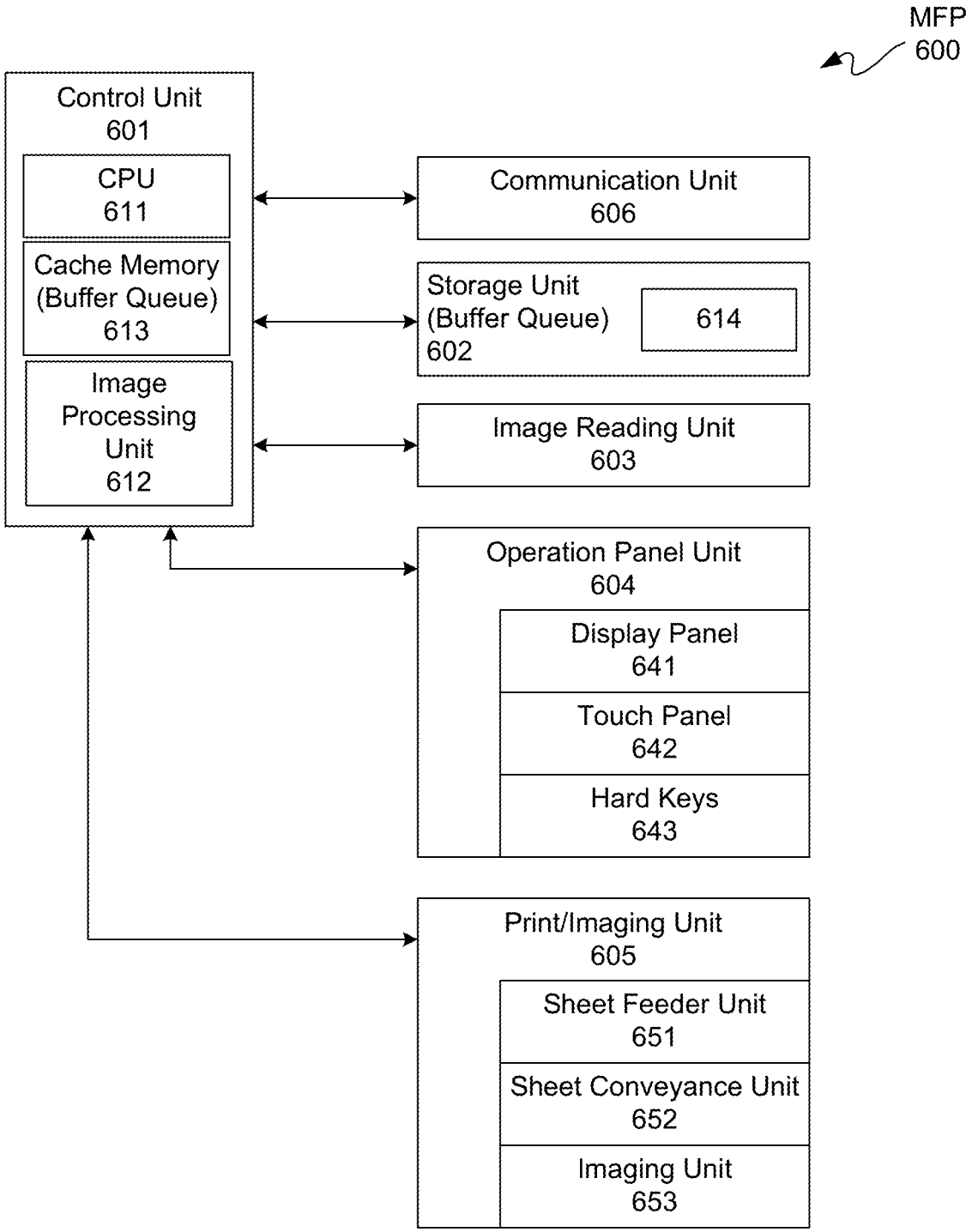

FIG. 6 is a block diagram depicting an example of a multi-function printer MFP 600. MFP 600 is provided for purposes of clarity by way of non-limiting example. MFP 600 is an example of an information processing system such as for handling a printer job as previously described having at least one plasma treatment for forming a concealed marking.

MFP 600 includes a control unit 601, a storage unit 602, an image reading unit 603, an operation panel unit 604, a print/imaging unit 605, and a communication unit 606. Communication unit 606 may be coupled to a network for communication with other peripherals, mobile devices, computers, servers, and/or other electronic devices.

Control unit 601 may include a CPU 611, an image processing unit 612, and cache memory 613. Control unit 601 may be included with or separate from other components of MFP 600. Storage unit 602 may include ROM, RAM, and large capacity storage memory, such as for example an HDD or an SSD. Storage unit 602 may store various types of data and control programs, including without limitation a printer imaging pipeline program 614. A buffer queue may be located in cache memory 613 or storage unit 602.

Operation panel unit 604 may include a display panel 641, a touch panel 642, and hard keys 643. Print/imaging unit 605 may include a sheet feeder unit 651, a sheet conveyance unit 652, and an imaging unit 653.

Generally, for example, for an MFP a copy image processing unit, a scanner image processing unit, and a printer image processing unit may all be coupled to respective direct memory access controllers for communication with a memory controller for communication with a memory. Many known details regarding MFP 600 are not described for purposes of clarity and not limitation.

Figure 7:
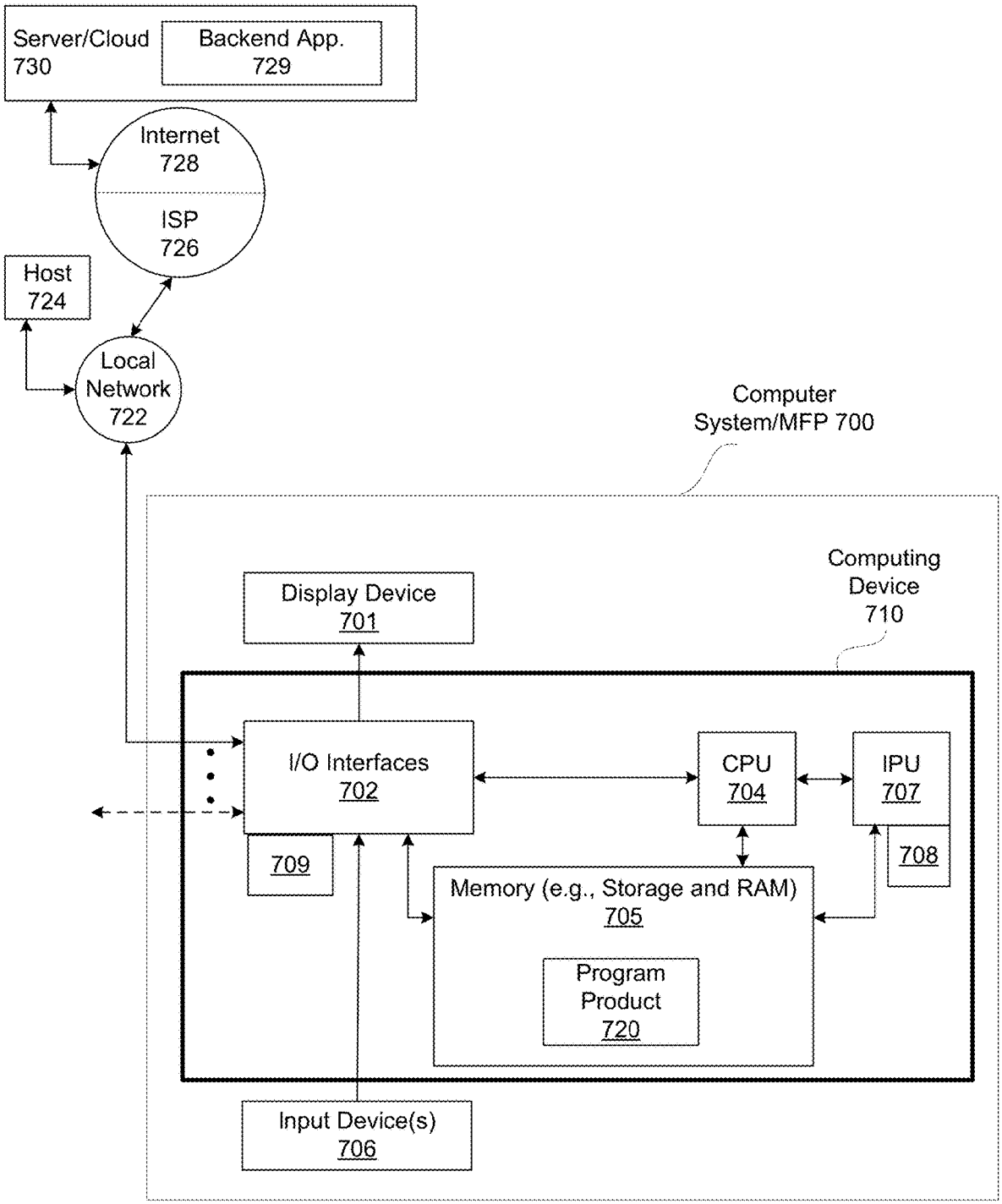
FIG. 7 is a block diagram depicting an example of a computer system.

FIG. 7 is a block diagram depicting an example of a computer system or MFP 700 ("computer system") upon which one or more aspects described herein may be implemented. Computer system 700 may include a programmed computing device 710 coupled to one or more display devices 701, such as Cathode Ray Tube ("CRT") displays, plasma displays, Liquid Crystal Displays ("LCDs"), Light Emitting Diode ("LED") displays, light emitting polymer displays ("LPDs") projectors and to one or more input devices 706, such as a keyboard and a cursor pointing device. Other known configurations of a computer system may be used. Computer system 700 by itself or networked with one or more other computer systems 700 may provide an information handling/processing system.

Programmed computing device 710 may be programmed with a suitable operating system, which may include Mac OS, Java Virtual Machine, Real-Time OS Linux, Solaris, iOS, Darwin, Android Linux-based OS, Linux, OS-X, UNIX, or a Windows operating system, among other platforms, including without limitation an embedded operating system, such as VxWorks. Programmed computing device 710 includes a central processing unit ("CPU") 704, one or more memories and/or storage devices ("memory") 705, and one or more input/output ("I/O") interfaces ("I/O interface") 702. Programmed computing device 710 may optionally include an image processing unit ("IPU") 707 coupled to CPU 704 and one or more peripheral cards 709 coupled to I/O interface 702. Along those lines, programmed computing device 710 may include graphics memory 708 coupled to optional IPU 707.

CPU 704 may be a type of microprocessor known in the art, such as available from IBM, Intel, ARM, and Advanced Micro Devices for example. CPU 704 may include one or more processing cores. Support circuits (not shown) may include busses, cache, power supplies, clock circuits, data registers, and the like.

Memory 705 may be directly coupled to CPU 704 or coupled through I/O interface 702. At least a portion of an operating system may be disposed in memory 705. Memory 705 may include one or more of the following: flash memory, random access memory, read only memory, magneto-resistive read/write memory, optical read/write memory, cache memory, magnetic read/write memory, and the like, as well as non-transitory signal-bearing media as described below. For example, memory 705 may include an SSD, which is coupled to I/O interface 702, such as through an NVMe-PCIe bus, SATA bus or other bus. Moreover, one or more SSDs may be used, such as for NVMe, RAID or other multiple drive storage for example.

I/O interface 702 may include chip set chips, graphics processors, and/or daughter cards, among other known circuits. In this example, I/O interface 702 may be a Platform Controller Hub ("PCH"). I/O interface 702 may be coupled to a conventional keyboard, network, mouse, camera, microphone, display printer, and interface circuitry adapted to receive and transmit data, such as data files and the like.

Programmed computing device 710 may optionally include one or more peripheral cards 709. An example of a daughter or peripheral card may include a network interface card ("NIC"), a display interface card, a modem card, and a Universal Serial Bus ("USB") interface card, among other known circuits. Optionally, one or more of these peripherals may be incorporated into a motherboard hosting CPU 704 and I/O interface 702. Along those lines, IPU 707 may be incorporated into CPU 704 and/or may be of a separate peripheral card.

Programmed computing device 710 may be coupled to a number of client computers, server computers, or any combination thereof via a conventional network infrastructure, such as a company's Intranet and/or the Internet, for example, allowing distributed use. Moreover, a storage device, such as an SSD for example, may be directly coupled to such a network as a network drive, without having to be directly internally or externally coupled to programmed computing device 710. However, for purposes of clarity and not limitation, it shall be assumed that an SSD is housed in programmed computing device 710.

Memory 705 may store all or portions of one or more programs or data, including variables or intermediate information during execution of instructions by CPU 704, to implement processes in accordance with one or more examples hereof to provide a program product 720. Program product 720 may be for implementing portions of process flows, as described herein for forming a concealed marking. Additionally, those skilled in the art will appreciate that one or more examples hereof may be implemented in hardware, software, or a combination of hardware and software. Such implementations may include a number of processors or processor cores independently executing various programs, dedicated hardware and/or programmable hardware.

Along those lines, implementations related to use of computing device 710 for implementing techniques described herein may be performed by computing device 710 in response to CPU 704 executing one or more sequences of one or more instructions contained in main memory of memory 705. Such instructions may be read into such main memory from another machine-readable medium, such as a storage device of memory 705. Execution of the sequences of instructions contained in main memory may cause CPU 704 to perform one or more process steps described herein. In alternative implementations, hardwired circuitry may be used in place of or in combination with software instructions for such implementations. Thus, the example implementations described herein should not be considered limited to any specific combination of hardware circuitry and software, unless expressly stated herein otherwise.

One or more program(s) of program product 720, as well as documents thereof, may define functions of examples hereof and can be contained on a variety of non-transitory tangible signal-bearing media, such as computer- or machine-readable media having code, which include, but are not limited to: (i) information permanently stored on non-writable storage media (e.g., read-only memory devices within a computer such as CD-ROM or DVD-ROM disks readable by a CD-ROM drive or a DVD drive); or (ii) alterable information stored on writable storage media (e.g., floppy disks within a diskette drive or flash drive or hard-disk drive or read/writable CD or read/writable DVD).

Computer readable storage media encoded with program code may be packaged with a compatible device or provided separately from other devices. In addition, program code may be encoded and transmitted via wired optical, and/or wireless networks conforming to a variety of protocols, including the Internet, thereby allowing distribution, e.g., via Internet download. In implementations, information downloaded from the Internet and other networks may be used to provide program product 720. Such transitory tangible signal-bearing media, when carrying computer-readable instructions that direct functions hereof, represent implementations hereof.

Along those lines the term "tangible machine-readable medium" or "tangible computer-readable storage" or the like refers to any tangible medium that participates in providing data that causes a machine to operate in a specific manner. In an example implemented using computer system 700, tangible machine-readable media are involved, for example, in providing instructions to CPU 704 for execution as part of programmed product 720. Thus, a programmed computing device 710 may include programmed product 720 embodied in a tangible machine-readable medium. Such a medium may take many forms, including those describe above.

The term "transmission media", which includes coaxial cables, conductive wire and fiber optics, including traces or wires of a bus, may be used in communication of signals, including a carrier wave or any other transmission medium from which a computer can read. Transmission media can also take the form of acoustic or light waves, such as those generated during radio-wave and infra-red data communications.

Various forms of tangible signal-bearing machine-readable media may be involved in carrying one or more sequences of one or more instructions to CPU 704 for execution. For example, instructions may initially be carried on a magnetic disk or other storage media of a remote computer. The remote computer can load the instructions into its dynamic memory and send such instructions over a transmission media using a modem. A modem local to computer system 700 can receive such instructions on such transmission media and use an infra-red transmitter to convert such instructions to an infra-red signal. An infra-red detector can receive such instructions carried in such infra-red signal and appropriate circuitry can place such instructions on a bus of computing device 710 for writing into main memory, from which CPU 704 can retrieve and execute such instructions. Instructions received by main memory may optionally be stored on a storage device either before or after execution by CPU 704.

Computer system 700 may include a communication interface as part of I/O interface 702 coupled to a bus of computing device 710. Such a communication interface may provide a two-way data communication coupling to a network link connected to a local network 722. For example, such a communication interface may be a local area network ("LAN") card to provide a data communication connection to a compatible LAN. Wireless links may also be implemented. In any such implementation, a communication interface sends and receives electrical, electromagnetic or optical signals that carry digital and/or analog data and instructions in streams representing various types of information.

A network link to local network 722 may provide data communication through one or more networks to other data devices. For example, a network link may provide a connection through local network 722 to a host computer 724 or to data equipment operated by an Internet Service Provider ("ISP") 726 or another Internet service provider. ISP 726 may in turn provide data communication services through a world-wide packet data communication network, the "Internet" 728. Local network 722 and the Internet 728 may both use electrical, electromagnetic or optical signals that carry analog and/or digital data streams. Data carrying signals through various networks, which carry data to and from computer system 700, are exemplary forms of carrier waves for transporting information.

Wireless circuitry of I/O interface 702 may be used to send and receive information over a wireless link or network to one or more other devices' conventional circuitry such as an antenna system, an RF transceiver, one or more amplifiers, a tuner, one or more oscillators, a digital signal processor, a CODEC chipset, memory, and the like. In some implementations, wireless circuitry may be capable of establishing and maintaining communications with other devices using one or more communication protocols, including time division multiple access (TDMA), code division multiple access (CDMA), global system for mobile communications (GSM), Enhanced Data GSM Environment (EDGE), wide-band code division multiple access (W-CDMA), Long Term Evolution (LTE), LTE-Advanced, WIFI (such as IEEE 802.11a, IEEE 802.11b, IEEE 802.11g and/or IEEE 802.11n), Bluetooth, Wi-MAX, voice over Internet Protocol (VoIP), near field communication protocol (NFC), a protocol for email, instant messaging, and/or a short message service (SMS), or any other suitable communication protocol. A computing device can include wireless circuitry that can communicate over several different types of wireless networks depending on the range required for the communication. For example, a short-range wireless transceiver (e.g., Bluetooth), a medium-range wireless transceiver (e.g., WIFI), and/or a long range wireless transceiver (e.g., GSM/GPRS, UMTS, CDMA2000, EV-DO, and LTE/LTE-Advanced) can be used depending on the type of communication or the range of the communication.

Computer system 700 can send messages and receive data, including program code, through network(s) via a network link and communication interface of I/O interface 702. In the Internet example, a server 730 might transmit a requested code for an application program through Internet 728, ISP 726, local network 722 and I/O interface 702. A server/Cloud-based system 730 may include a backend application for providing one or more applications or services as described herein. Received code may be executed by processor 704 as it is received, and/or stored in a storage device, or other non-volatile storage, of memory 705 for later execution. In this manner, computer system 700 may obtain application code in the form of a carrier wave.

While the foregoing describes exemplary apparatus(es) and/or method(s), other and further examples in accordance with the one or more aspects described herein may be devised without departing from the scope hereof, which is determined by the claims that follow and equivalents thereof. Claims listing steps do not imply any order of the steps. Trademarks are the property of their respective owners.

What is claimed is:

1. A method for forming a concealable marking on a medium, comprising:

obtaining a printing device having a printhead, a first plasma head, a second plasma head, a platform, and a stencil holder;

wherein the printhead is configured to print to a surface of the medium;

wherein the first plasma head and the second plasma head respectively are configured to provide a first plasma and a second plasma;

wherein the platform is configured to support and transport the medium;

wherein the stencil holder is configured to hold a first stencil and a second stencil between the surface of the medium and the first plasma head and the second plasma head, respectively;

covering a first region of the surface of the medium with the first stencil;

wherein the first stencil defines at least one first opening for exposure of a portion of the first region of the surface;

generating the first plasma with the first plasma head;

exposing the portion of the first region of the surface of the medium to the first plasma through the at least one first opening to hydrophilize the portion of the first region of the surface to provide the concealable marking;

covering a second region of the surface of the medium with the second stencil defining at least one second opening for exposure of a portion of the second region of the surface;

generating the second plasma with the second plasma head; and exposing the portion of the second region of the surface of the medium to the second plasma through the at least one second opening to hydrophilize the portion of the second region of the surface to provide the concealable marking.

2. The method according to claim 1, further comprising printing content in the portion of the first region on the surface of the medium.

3. The method according to claim 2, wherein the first stencil is a ceramic or metal patterned mask having a thickness of less than 10 millimeters.

4. The method according to claim 1, wherein exposure time to the first plasma from the first plasma head is different than exposure time to the second plasma from the second plasma head to respectively provide a first hydrophilic state and a second hydrophilic state on the surface observably different from one another in a wet state of the surface.

5. The method according to claim 1, wherein the first plasma head and the second plasma head are set for different intensities to respectively provide a first hydrophilic state and a second hydrophilic state on the surface observably different from one another in a wet state of the surface.

6. The method according to claim 1, wherein:

the at least one second opening is different from the at least one first opening;

the covering of the second region includes aligning the second stencil to have the at least one second opening at least partially overlap the first region.

7. The method according to claim 1, wherein the first plasma from the first plasma head and the second plasma from the second plasma head are each an atmospheric gas plasma to provide the concealable marking without any colorant.

8. A method for forming a concealable marking on a medium, comprising:

obtaining a printing device having a printhead, at least one plasma head, a platform, and a stencil holder;

wherein the printhead is configured to print to a surface of the medium;

wherein the at least one plasma head is configured to provide at least one plasma;

wherein the platform is configured to support and transport the medium;

wherein the stencil holder is configured to hold a first stencil and a second stencil between the surface of the medium and the at least one plasma head;

first covering a first region of the surface of the medium with the first stencil;

the first stencil defining at least one first opening for exposure of a first portion of the first region of the surface;

first generating the at least one plasma with the at least one plasma head;

first exposing the first portion of the surface of the medium to the at least one plasma to hydrophilize the first portion of the surface thereof;

second covering a second region of the surface of the medium with the second stencil;

wherein the second stencil defines at least one second opening for exposure of a second portion of the second region of the surface and different from the at least one first opening;

the second covering including aligning the second stencil to have the at least one second opening at least partially overlap the first portion;

second generating the at least one plasma with the at least one plasma head; and second exposing the second portion of the surface of the medium to the at least one plasma from the at least one plasma head to hydrophilize the second portion of the surface thereof including to further hydrophilize an at least partially overlapped portion with the first portion to provide the concealable marking on the medium.

9. The method according to claim 8, wherein the at least partially overlapped portion has a different shade than a remainder of the first portion thereof when wet.

10. The method according to claim 9, further comprising printing an image on the at least partially overlapped portion on the surface of the medium.

11. The method according to claim 10, wherein the first stencil and the second stencil each have a thickness of less than 10 millimeters.

12. The system according to claim 10, wherein exposure time to the at least one plasma from the first exposing is different than exposure time to the at least one plasma from the second exposing to respectively provide a first hydrophilic state and a second hydrophilic state on the surface observably different from one another in a wet state of the surface.

13. The method according to claim 10, wherein a first intensity of the at least one plasma from the first exposing is different than a second intensity of the at least one plasma from the second exposing to respectively provide a first hydrophilic state and a second hydrophilic state on the surface observably different from one another in a wet state of the surface.

14. The method according to claim 10, wherein the at least one plasma is an atmospheric gas plasma to provide the concealable marking without any colorant.

* * * * *